US005120142A

United States Patent [19]

Fujiwara et al.

[11] Patent Number: 5,120,142

[45] Date of Patent: Jun. 9, 1992

[54] SOLENOID CONTROLLING APPARATUS

[75] Inventors: Takashi Fujiwara, Okazaki; Masayuki Matsubayashi, Nagoya, both of Japan

[73] Assignee: Brother Kogyo Kabushiki Kaisha, Baar, Switzerland

[21] Appl. No.: 554,020

[22] Filed: Jul. 17, 1990

[30] Foreign Application Priority Data

Jul. 18, 1989 [JP] Japan ..... 1-185051

[51] Int. Cl.[5] ..... B41J 9/50; B41J 9/38

[52] U.S. Cl. ..... 400/157.2; 361/154

[58] Field of Search ..... 400/88, 157.2, 157.3, 400/166; 361/152, 154

[56] References Cited

U.S. PATENT DOCUMENTS

| | | | |
|---|---|---|---|
| 3,909,681 | 9/1975 | Campari et al. | 400/157.2 |
| 4,407,193 | 10/1983 | Hall | 400/157.3 |
| 4,745,514 | 5/1988 | Takeshima | 361/154 |

FOREIGN PATENT DOCUMENTS

| | | | |
|---|---|---|---|
| 0067936 | 12/1982 | European Pat. Off. | 400/157.2 |
| 118882 | 9/1981 | Japan | 400/166 |
| 128882 | 8/1983 | Japan | 400/166 |
| 142873 | 8/1983 | Japan | 400/166 |
| 158278 | 9/1983 | Japan | 400/166 |
| 156759 | 9/1984 | Japan | 400/166 |
| 52371 | 3/1985 | Japan | 400/166 |
| 61-263776 | 11/1986 | Japan | 400/157.2 |
| 0263949 | 4/1988 | Japan | 400/157.2 |

OTHER PUBLICATIONS

European Search Report Appl. No. EP 90307822.8.

*Primary Examiner*—David A. Wiecking
*Assistant Examiner*—Steven S. Kelly
*Attorney, Agent, or Firm*—Kane, Dalsimer, Sullivan, Kurucz, Levy, Eisele and Richard

[57] ABSTRACT

In a printing device employing a solenoid for driving a printing hammer, provided are switching member for ON/OFF operating electric current flowing through the solenoid coil, voltage generating member for generating voltage in accordance with the electric current, converting member for converting the generated voltage to a digital value, chopping member for comparing the converted digital value with a predetermined comparison value, while for turning on the switching member when the converted value is smaller than the predetermined comparison value and turning off the switching member when the converted value is larger than the predetermined comparison value, detecting member for detecting voltage relating to a driving operation of said solenoid, and controlling member for controlling the predetermined comparison value so as to be varied in an amount based upon the detected voltage. Thus, the current flowed through the solenoid is controlled so as not to be largely varied.

15 Claims, 9 Drawing Sheets

SOLENOID CONTROLLING APPARATUS

BACKGROUND OF THE INVENTION

The present invention relates to a controlling apparatus of a solenoid used for driving a printing section of a printing unit (for example, a printing hammer, a wire, and the like for striking a printing element wheel), more particularly to a controlling apparatus of a solenoid for controlling electric current which flows through a solenoid so as not to be largely varied. This type of controlling apparatus, proposed by the same assignee in, for example Japanese Provisonal Publication SHO 61-263776, has been known.

FIG. 1 shows an outline of a printing mechanism of a typewriter to which the present invention is to be applied. A carriage 102 is reciprocally moved along a platen 100. The carriage 102 holds a daisy shaped printing element wheel 104 with a large number of printing elements on the peripheral position thereof. The printing element wheel 104 is connected to a printing element selection motor 106. Behind the printing element wheel 104, a printing hammer unit 108 is supported by the carriage 102. A hammer 110 of the printing hammer unit 108 is advanced and a selected printing element of the printing element wheel 104 is struck via a printing ribbon 114 from the backside of the printing element wheel 104 to a sheet 112 held by the platen 100 and thereby the desired letter is printed on the sheet 112.

The hammer 110 is driven by a solenoid 116 shown in FIG. 2. The solenoid 116 is fixed in a housing 118 of the printing hammer unit 108. Inside the housing 118, the hammer 110 is movably held by guide members 120 and 122. The hammer 110 is tensioned to the retreat position by an elastic spring 124. However, when the solenoid 116 is powered, the hammer 110 advances against the tension force of the spring 124 and strikes the rear surface of the specified printing element of the printing element wheel 104 as described above.

It is preferred by controlling the solenoid current to keep it constant while the hammer 110 is struck so as to stable the impact force. An outline of a typical control circuit for that is shown in FIG. 3.

A power supply to the solenoid 116 is turned on and off by a switching circuit 126. The solenoid current is converted into voltage value by a resister 128 for detecting the current. The resultant voltage is converted into a digital value, hereinafter named the A/D (Analog/Digital) conversion value, by an A/D converter 130 and a reference voltage generating circuit 132. The A/D conversion value is output to a controlling circuit 134. In this example, the A/D converter 130, the reference voltage generating circuit 132, and the controlling circuit 134 are included in a CPU (Central Processing Unit) 134-1. The control circuit 134 of the CPU 134-1 executes a chopping control operation where it compares a digital value, i.e., the A/D conversion value, with a predetermined comparison value and turns on the switching circuit 126 when the digital value is smaller than the comparison value, while the control circuit 134 turns off the switching circuit 126 when the digital value is greater than the comparison value. Thus, the solenoid current becomes a saw shape in one printing cycle, hereinafter named a solenoid drive time period, so that the current becomes stable in accordance with the comparison value.

However, in the above solenoid control operation, when the solenoid drive voltage is unstable, that is in the unstable state, the rise slope of the solenoid current depends on the solenoid drive voltage. Thus, if the process speed of the A/D converter is slow (for example, the A/D coverter incorporated in a CPU is used). the instability of the solenoid drive voltage causes the solenoid current remarkably to deviate.

FIG. 4A shows a chart of the deviation of the solenoid driving current. As apparently shown in the drawing, when the solenoid drive voltage value "V" is low value "Vl", i.e., V=Vl, the solenoid current is also low as shown by the solid line in the drawing. On the other hand, when the solenoid drive voltage value "V" is high value "Vh", i.e., V=Vh, the solenoid current relatively becomes high as shown by the dot line in the drawing. Now, such a phenomenon will be further described hereinafter in detail by referring to FIG. 4B which is an enlarged view of portion "A" of FIG. 4A.

When the solenoid drive voltage "V" is low in one cycle of A/D conversion time period, i.e., V=Vl, the solenoid driving current "Io" is slowly increased. Thus, when it is determined that the A/D conversion value is greater than the comparison value, the solenoid current becomes "Vlmax". When the power supply is turned off, the current decreases to "Vlmin". On the other hand, in the same A/D conversion time period, when the solenoid drive voltage is high, i.e., V=Vh, the rise slope of the solenoid current becomes sharper than that of the low voltage state, i.e., V=Vl. Thus, when it is determined that the A/D conversion value is greater than the comparison value, the solenoid current increases to "Vhmax". When the power supply to the solenoid is turned off, the solenoid current decreases to "Vhmin."

The difference of the amount of the solenoid current results in a deviation due to unstableness of the solenoid drive voltage. Thus, the impact force of each printing operation deviates and thereby the printing quality tends to be unequal.

SUMMARY OF THE INVENTION

It is therefore an object of the invention to provide an improved solenoid controlling apparatus for supplying as stable a solenoid current as possible even if the solenoid drive voltage is not stable, by correcting the comparison value in accordance with the solenoid drive voltage value.

For this purpose, according to the present invention, there is provided a solenoid controlling apparatus, for controlling electric current flowing through said solenoid, comprising switching means for ON/OFF operating the electric current, value setting means for setting a digital value in accordance with the electric current, and chopping means for comparing the set value with predetermined comparison value, while for turning on said switching means when the set value is smaller than the predetermined comparison value and turning off the switching means when the set value is larger than the predetermined comparison value, said solenoid controlling apparatus further comprising:

detecting means for detecting voltage relating to a driving operation of said solenoid; and controlling means for controlling said predetermined comparison value so as to be varied in an amount based upon the detected voltage.

DESCRIPTION OF THE ACCOMPANYING DRAWINGS

DESCRIPTION OF THE EMBODIMENTS

Referring to the accompanying drawings, an embodiment will be described hereinafter.

Figure 1:
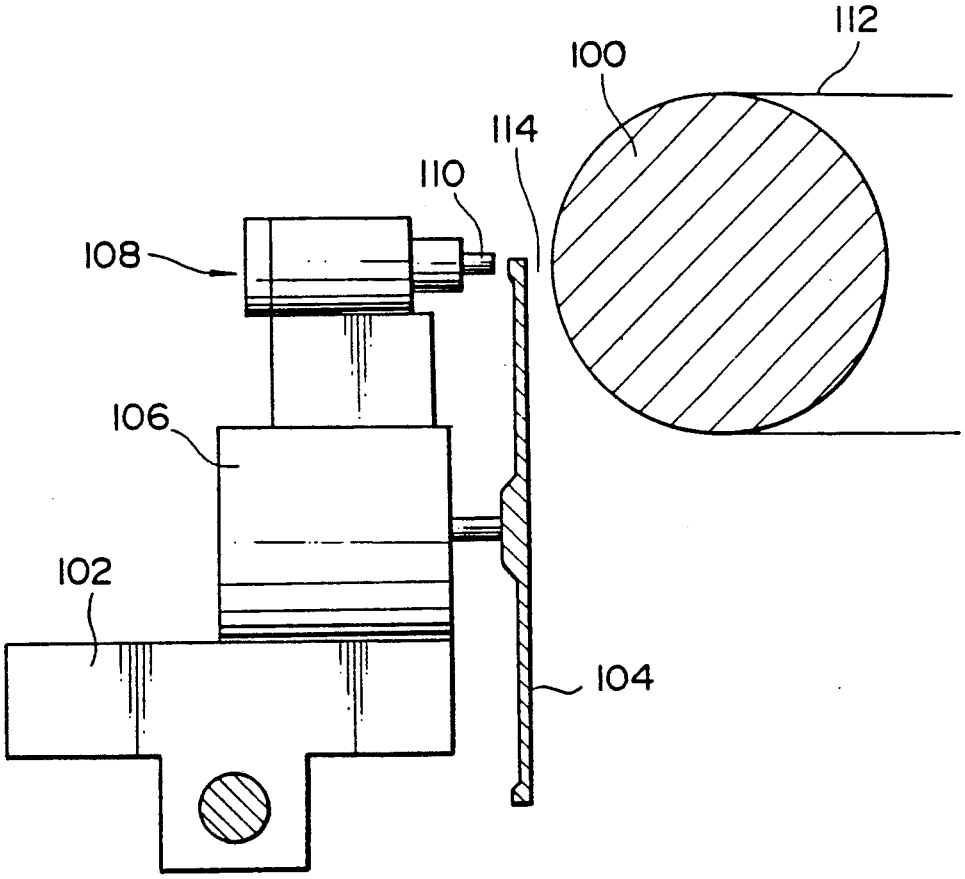
FIG. 1 is a sectional view showing an outline of a printing section of a printing device to be controlled by the solenoid controlling apparatus according to the present invention.
Figure 2:
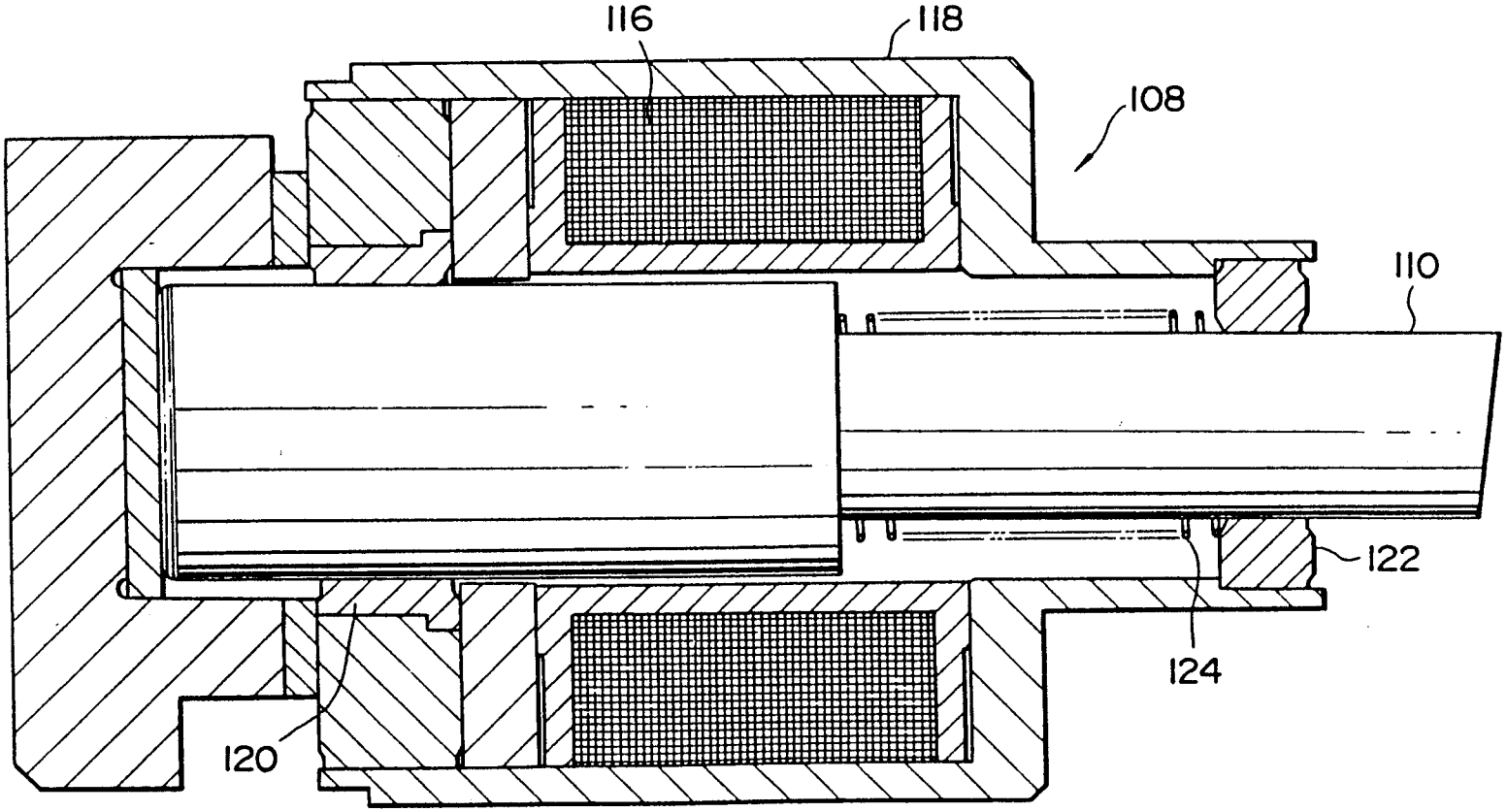
FIG. 2 is a sectionally enlarged view of the printing hammer unit incorporated in the printing device of FIG. 1.
Figure 3:
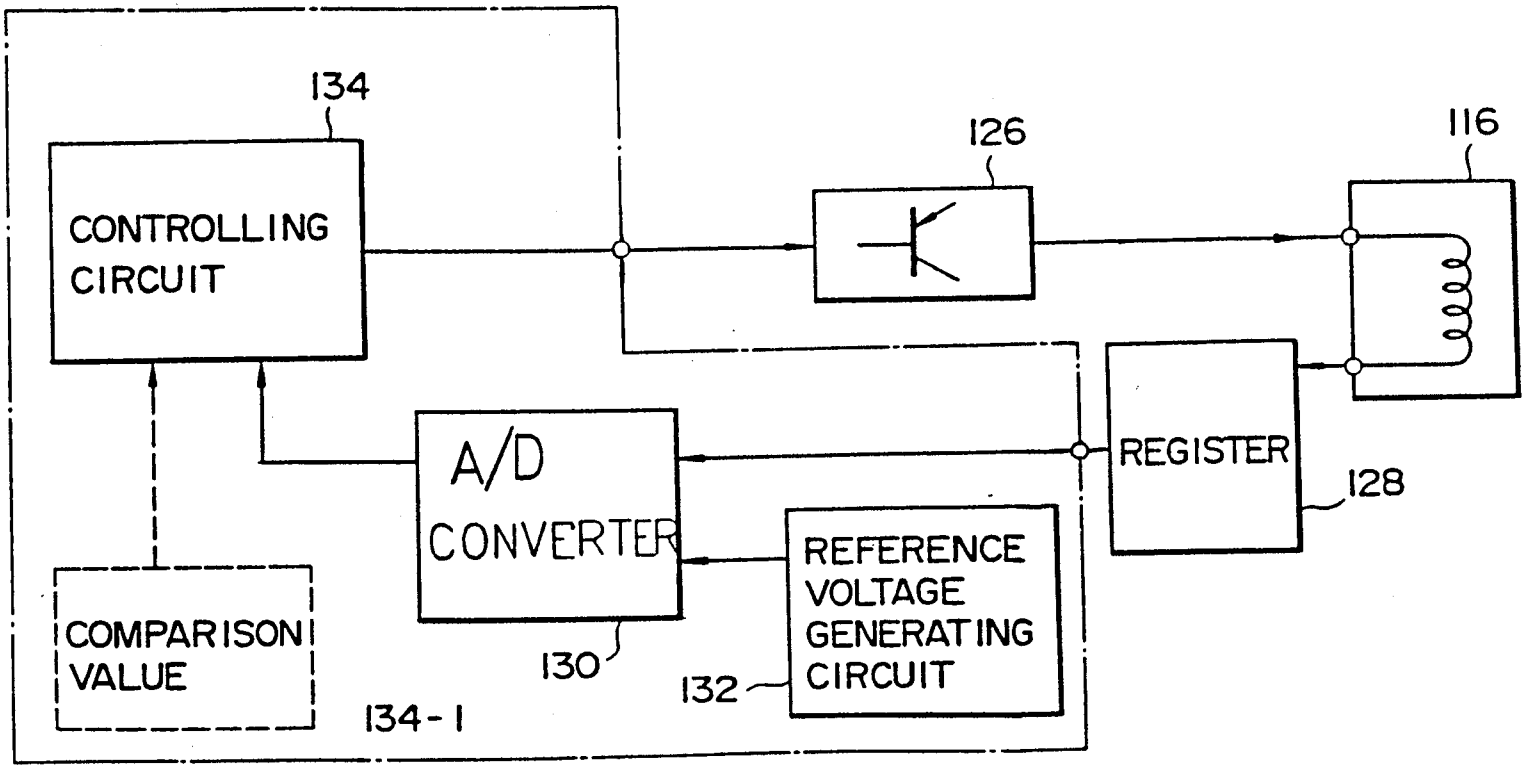
FIG. 3 is a circuit diagram showing the hardware control section of the solenoid of the printing hammer unit of FIG. 2.
Figure 4A:
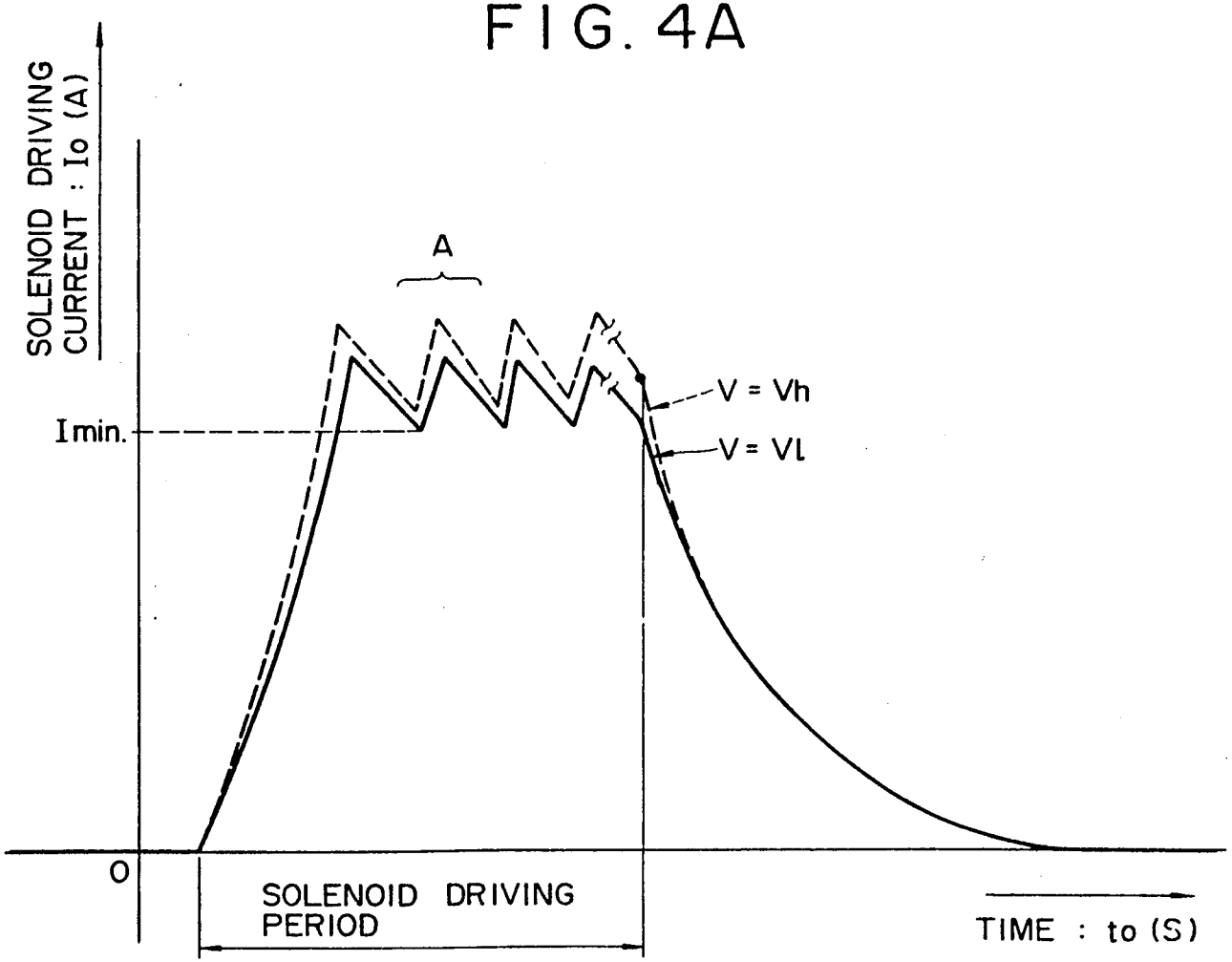
FIGS. 4A and 4B are a diagram showing solenoid driving current characteristic during a solenoid controlling operation, and a partial enlarged diagram thereof.
Figure 4B:
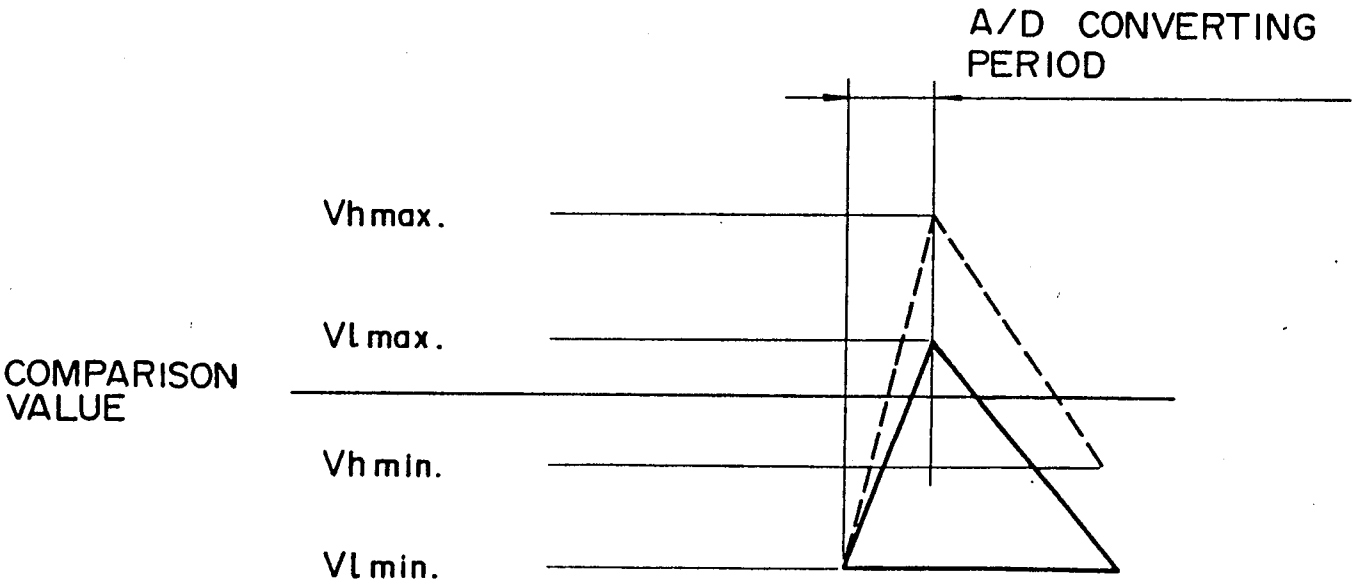

In this embodiment, the printing hammer unit 108 for a daisy shaped printing element wheel type typewriter shown in FIG. 1 is used. The hammer drive solenoid 116 is controlled.

Figure 5A:
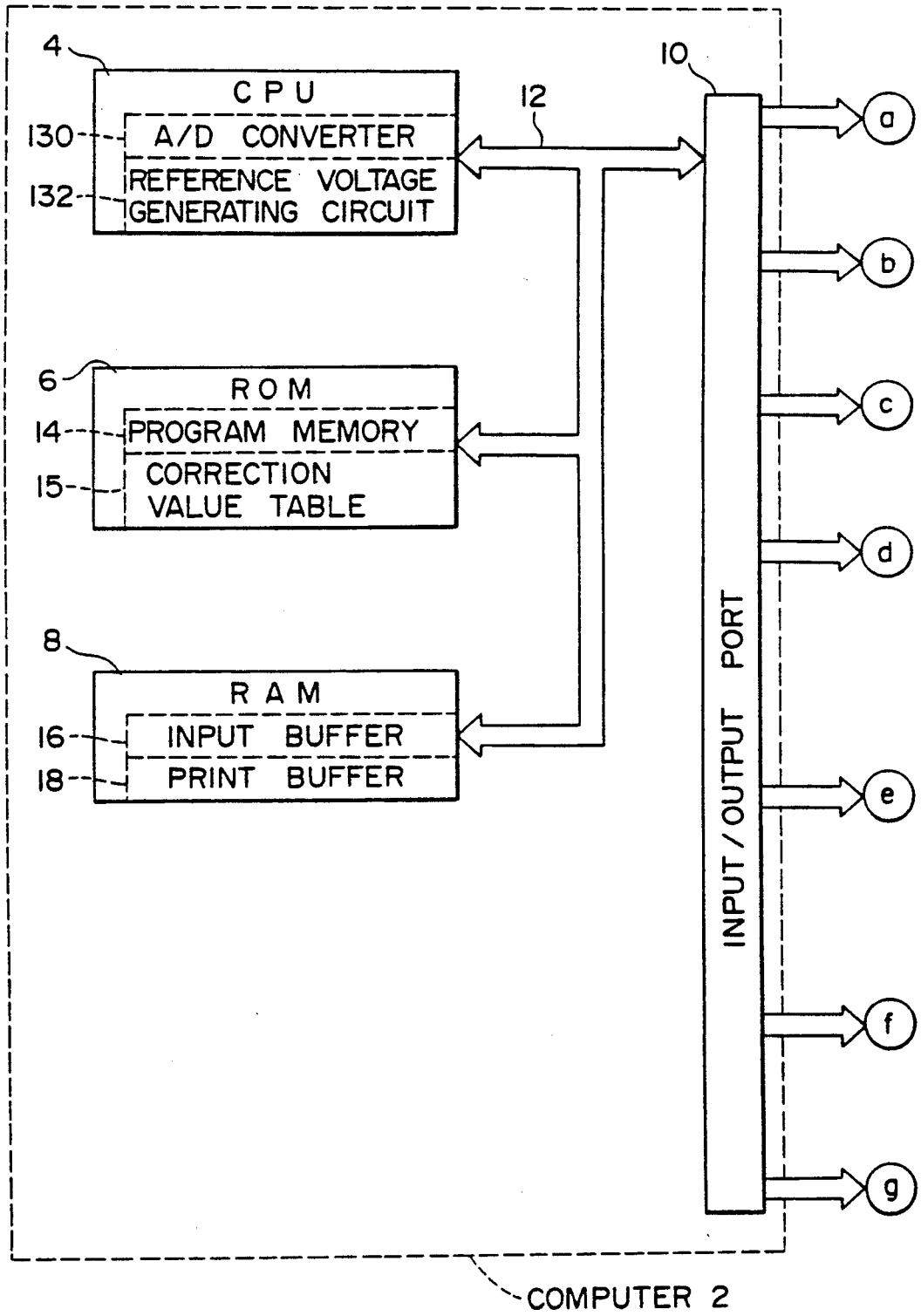
FIGS. 5A and 5B are block diagrams of the entire control section of the printing device including the solenoid controlling apparatus embodying the present invention.
Figures 5, 5B:
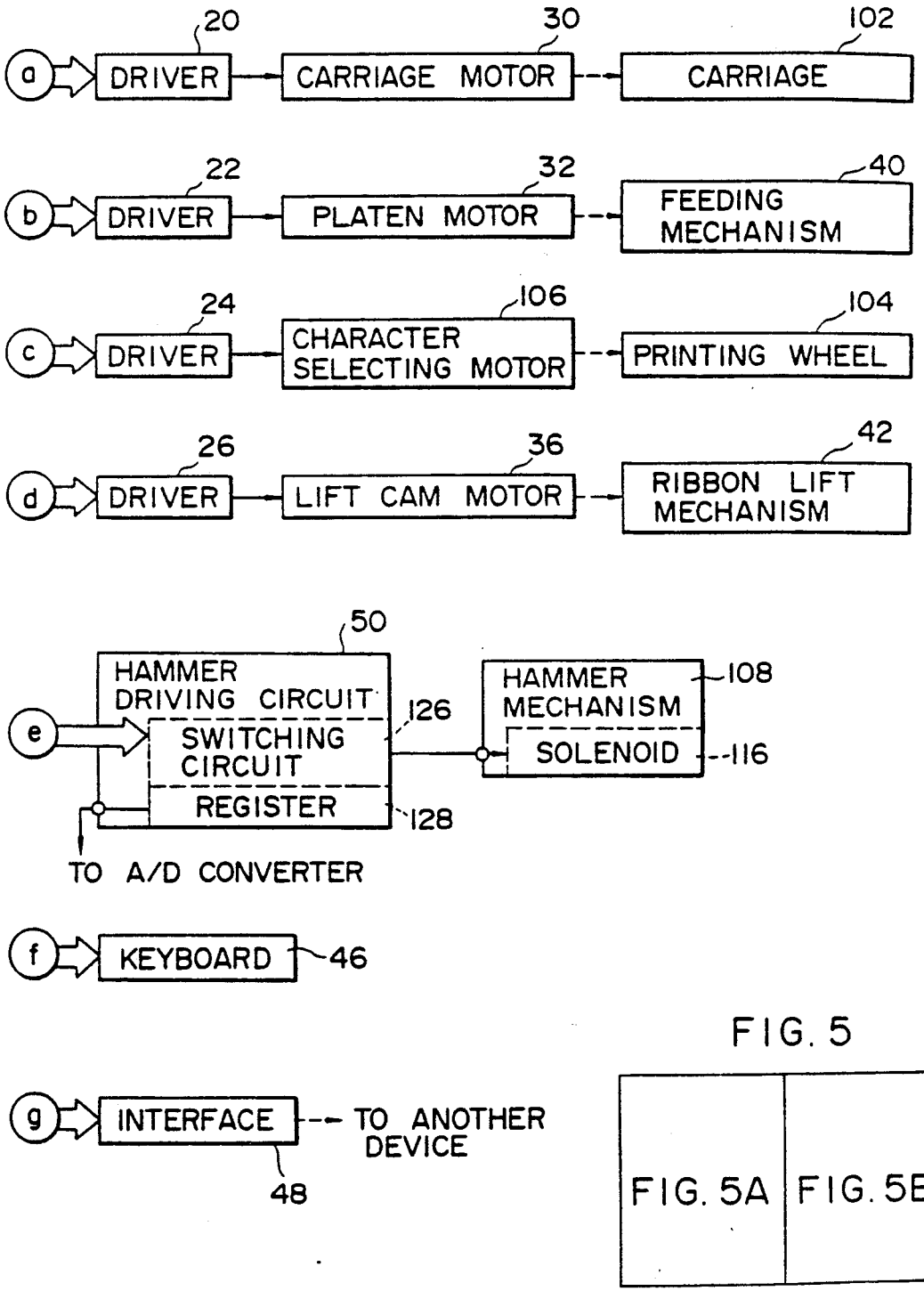

FIG. 5 is a block diagram showing the entire control operations of the typewriter. The principal section of the drawing is a computer 2. The computer 2 is provided with a CPU (Central Processing Unit) 4 for executing various computation control operations necessary for the typewriter operations, a ROM (Read Only Memory) 6 for storing program data and various constants, a RAM (Random Access Memory) 8 for reading and writing data therefrom and thereto, and an I/O (Input/Output) part 10, including a plurality of ports, for receiving and/or transmitting the data, each of ports are respectively connected to a bus line 12.

The CPU 4 is provided with the A/D converter 130 for converting an analog input signal to a digital signal and the reference voltage generating circuit 132 for generating reference voltage to be compared with the converted signal necessary for the A/D conversion. In a program memory 14 of the ROM 8, besides a solenoid control program described later, other programs necessary for the entire process of the typewriter are stored. In the ROM 6, a correction value table 15 for correcting a comparison value according to an A/D conversion value described later is provided. In the correction value table 15, for example, as shown in Table 1, correction values which are reversely proportional to the solenoid drive voltages are stored as a conversion table.

TABLE 1

| DRIVING VOLTAGE: V(v) | CORRECTION VALUE |
|---|---|
| 40–38 | −1 |
| 38–36 | 0 |
| 36–34 | 0 |
| 34–32 | +1 |
| 32–30 | +2 |
| 30–28 | +2 |

TABLE 1-continued

| DRIVING VOLTAGE: V(v) | CORRECTION VALUE |
|---|---|
| 28–26 | +3 |
| 26–24 | +5 |
| 24–0 | +6 |

The RAM 8 serves for working areas of an input buffer 16, a print buffer 18, and so on.

As well known, the I/O port 10 is connected to various motors 30, 32, 106, and 36 via drivers 20, 22, 24, and 26. These motors respectively drive each of the carriage 102, a sheet feed mechanism 40 including the platen 100, the printing element wheel 104, and a known ribbon lift mechanism 42. In addition, the I/O port 10 is connected to a keyboard 46 and to an interface 48 for connecting the apparatus to another external device.

Figure 6:
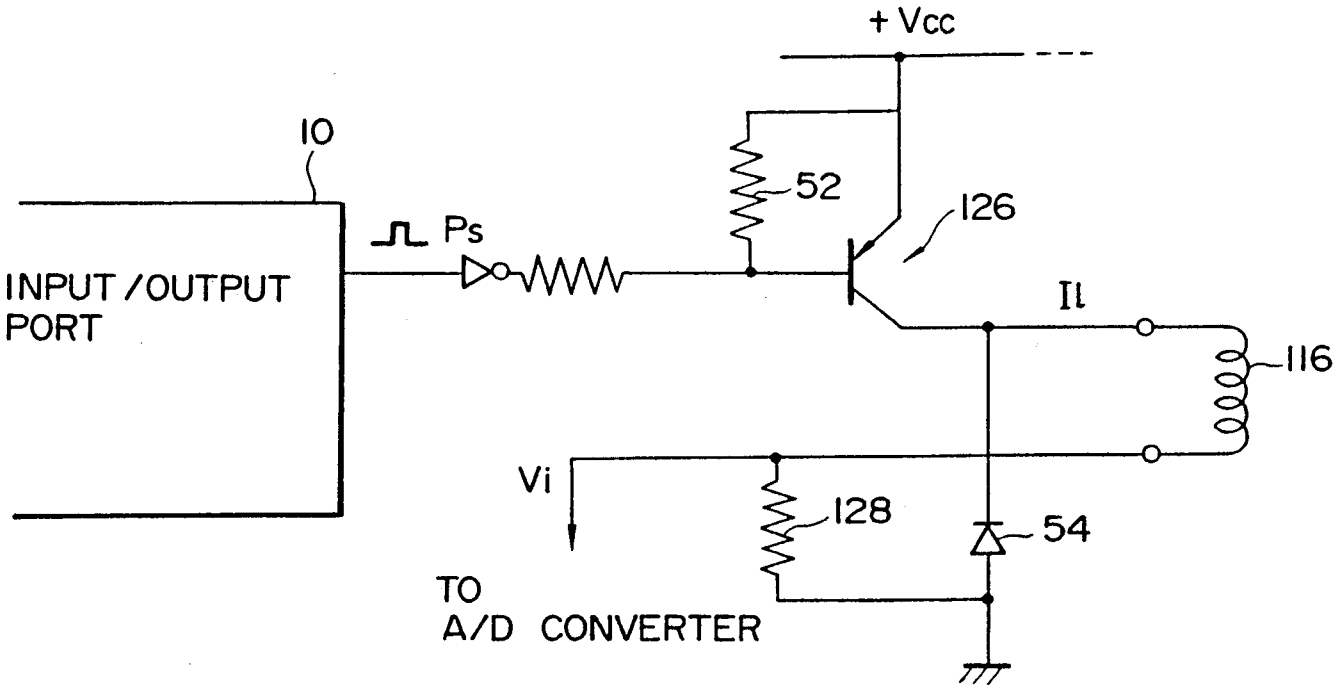
FIG. 6 is a schematic of a hammer drive circuit of FIG. 5.

In addition, the printing hammer unit 108 is also connected to the I/O port 10 via a hammer driving circuit 50. The hammer driving circuit 50 is provided with a switching circuit 126 for turning on and off the current to the solenoid 116 of the printing hammer unit 108, and a resister 128 for detecting a voltage which is converted from the current which flows in the solenoid 116. This section is shown in detail in FIG. 6.

The switching circuit 128 is provided with a transistor 52 as a switching element, the transistor 52 being turned on or off according to a pulse control signal "Ps" which is output from the I/O port 10 so as to control the current which flows to the solenoid 116 of the printing hammer unit 108. The resister 128 is connected serially to the solenoid 116, the voltage according to the solenoid current being input to the reference voltage circuit 132. The collector of the transistor 52 is connected to a flywheel diode 54 for protecting a reverse current from flowing thereto.

Figure 7:
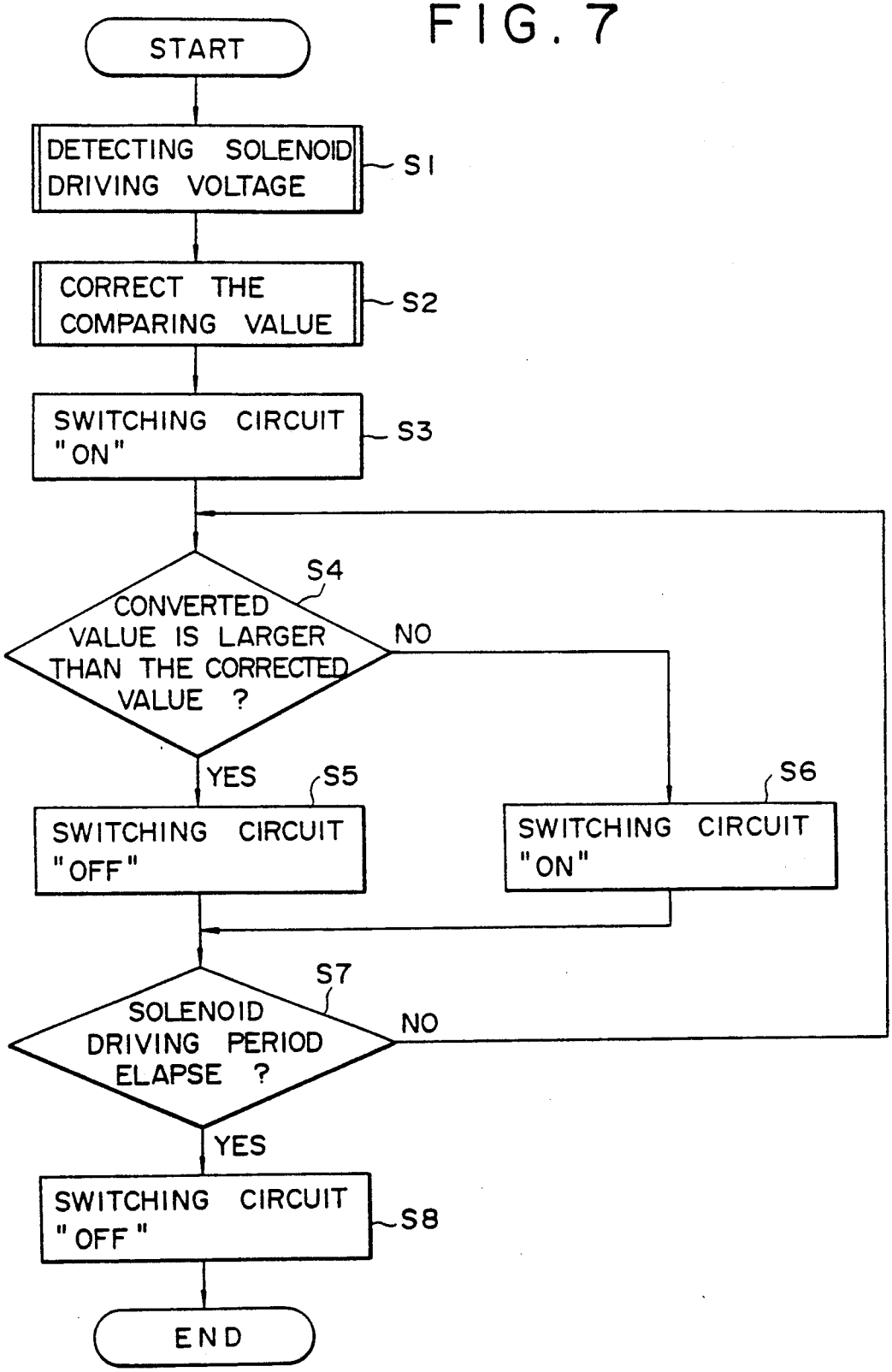
FIG. 7 is a flowchart of the controlling operation executed by the solenoid controlling apparatus according to the present invention.

A program which is stored in the program memory 14 of the ROM 6 and closely relate to the solenoid drive control operation according to the present invention will be described hereinafter by referring to a flowchart of FIG. 7.

First, in step S1, a solenoid driving voltage is dectected. In this embodiment, the CPU 4 detects a power supply voltage of the solenoid 116. In step S2, the CPU 4 reads a correction value according to the solenoid drive voltage from the correction value table 15 of the ROM 6. According to the example shown in the Table 1, when the solenoid driving voltage being detected is 27(V), for example, the correction value becomes +3. When the solenoid driving voltage is 39(V), for example, the correction value becomes −1. The CPU 4 executes a correcting operation for adding the correction value being read to the comparison value to be compared with the A/D conversion value. In step S3, the switching circuit 126 is turned on and thereby the power to the solenoid 116 of the printing hammer unit 108 is turned on, the solenoid current being converted into a voltage by the resister 128 and input to the A/D converter 130 of the CPU 4. The A/D converter 130 uses a reference voltage generated by the reference voltage circuit 132 for the comparison and converts such a voltage into a digital value, i.e., A/D conversion value.

In S4, the CPU 4 compares the A/D conversion value with the comparison value having been corrected in accordance with the correction value table. When the A/D conversion value is less than the comparison value, the process is looped from steps S4, S6, S7, and to S4, wherein the power supply of the solenoid 116 remains on. When it is determined that the A/D conversion value exceeds the comparison value, in step S5 the switching circuit 126 is temporarily turned off and the power supply to the solenoid 116 is turned off. In step S7, unless the solenoid drive time period per print cycle elapsed, the process is returned back to step S4. In step S4, the A/D conversion value according to the solenoid current is compared with the comparison value. When the A/D conversion value is smaller than the comparison value, in S6 the switching circuit 126 is turned on again. After that, until the solenoid drive time period is elapsed, the control operations of steps S4 and S5 or those of S6 and S7 are repeated. The chopping control operation by repeating the on and off operations causes the solenoid current to have a saw shaped amplitude. When it is determined that the solenoid drive time period elapsed in step S7, the switching circuit 126 is lastly turned off in step S8 and the hammer 110 of the printing hammer unit 108 is restored to the retreat position by the spring 124. According to the above embodiment, the power supply as the solenoid driving voltage to the solenoid in the cycle of the process time period of the A/D converter is turned on and off so that the solenoid current becomes stable in a predetermined range.

As described above, the current which flows to the solenoid 116 becomes stable. If the rise slope of the solenoid current becomes sharp and thereby the current value increases, since the above comparison value is corrected to a low value, the solenoid current also decreases. On the other hand, when the rise slope of the solenoid current is gradual and thereby the current value decreases, since the above comparison value is corrected to a high value, the solenoid current increases. Consequently, the effect of deviation of the solenoid drive voltage is reduced or removed, resulting in making stable the solenoid current.

In the above embodiment, before the power is supplied to the solenoid, the power voltage value is detected as the solenoid drive voltage value. However, it may be considered that after the power is supplied to the solenoid, the voltage which is generated by the current detecting resistor and then A/D converted can be detected as the solenoid drive voltage.

In addition, it is apparent to those skilled in the art that various modifications may be made and other embodiments implemented without departing from the scope of the present invention.

What is claimed is:

1. A solenoid controlling apparatus, for controlling electric current flowing through said solenoid, comprising switching means for ON/OFF operating the electric current, value outputting means for outputting a digital value in accordance with the electric current, and chopping means for comparing the value outputted by said outputting means with a predetermined comparison value, and for turning on said switching means when said outputted value is smaller than the predetermined comparison value and turning off said switching means when said outputted value is larger than or equal to said predetermined comparison value, said solenoid controlling apparatus further comprising:

detecting means for detecting voltage relating to a driving operation of said solenoid;

determining means for determining if a predetermined driving period has elapsed and thereupon deactivating said switching means; and controlling means for controlling said predetermined comparison value so as to be varied in an amount based upon the detected voltage, said predetermined comparison value being held constant throughout said predetermined solenoid driving period.

2. The solenoid controlling apparatus according to claim 1, wherein said value outputting means comprises a voltage generating means for generating voltage in accordance with the electric current and converting means for converting the generated voltage to a corresponding digital value.

3. The solenoid controlling apparatus according to claim 2, wherein said voltage generating means comprises a resister element through which the current flows and wherein said converting means comprises an A/D converter, whereby the voltage proportional to the electric current is generated between the terminals of said resister element and the generated voltage is converted to a corresponding digital value.

4. The solenoid controlling apparatus according to claim 1, wherein said controlling means varies said predetermined comparison value to be increased when the detected voltage is smaller than a predetermined value, while to be decreased when the detected voltage is larger than another predetermined value which is larger than said predetermined value.

5. The solenoid controlling apparatus according to claim 1, wherein said voltage relating to the driving operation of said solenoid is voltage of power source for driving said solenoid.

6. The solenoid controlling apparatus according to claim 1, wherein said switching means comprises a transistor arranged to be ON operated when a trigger pulse is supplied to a base thereof and a trigger pulse generating member for supplying the trigger pulse to the base of said transistor when the outputted value is smaller than the predetermined comparison value.

7. The solenoid controlling apparatus according to claim 4, wherein said controlling means further controls said predetermined comparison value so as not to be varied when a value of the detected voltage is between said predetermined value and said another predetermined value.

8. A printing device, for printing a character and/or symbol data on a predetermined printing medium by means of a printing hammer arranged to be driven by a solenoid, comprising:

switching means for ON/OFF operating electric current flowing through said solenoid;

determining means for determining if a predetermined driving period has elapsed and thereupon deactivating said switching means;

value outputting means for outputting a digital value in accordance with the electric current;

chopping means for comparing the value outputted by said outputting means with a predetermined comparison value, and for turning on said switching means when said outputted value is smaller than the predetermined comparison value and turning off said switching means when said outputted value is larger than or equal to said predetermined comparison value;

detecting means for detecting voltage relating to a driving operation of said solenoid; and controlling means for controlling said predetermined comparison value so as to be varied in an amount based upon the detected voltage, said predetermined comparison value being held constant throughout said predetermined solenoid driving period.

9. The printing device according to claim 8, wherein said value outputting means comprises voltage generating means for generating voltage in accordance with the electric current and converting means for converting the generated voltage to a digital value.

10. The printing device according to claim 9, wherein said voltage generating means comprises a resister element through which the current flows and wherein said converting means comprises an A/D converter, whereby the voltage proportional to the electric current is generated between the terminals of said resister element and the generated voltage is converted to a corresponding digital value.

11. The printing device according to claim 8, wherein said controlling means varies said predetermined comparison value to be increased when the detected voltage is smaller than a predetermined value, while to be decreased when the detected voltage is larger than another predetermined value which is larger than said predetermined value.

12. The printing device according to claim 8, wherein said voltage relating to the driving operation of said solenoid is voltage of power source for driving said solenoid.

13. The printing device according to claim 8, wherein said switching means comprises a transistor arranged to be ON operated when a trigger pulse is supplied to a base thereof and a trigger pulse generating member for supplying the trigger pulse to the base of said transistor when the converted value is smaller than the predetermined comparison value.

14. The printing device according to claim 11, wherein said controlling means further controls said predetermined comparison value so as not to be varied when a value of the detected voltage is between said predetermined value and said another predetermined value.

15. A current controlling system adapted to be positioned in a device including at least a power source for generating electric current flowing through a predetermined element provided on said device, switching means for ON/Off operating the electric current, value outputting means for outputting a digital value in accordance with the electric current, and chopping means for comparing the digital value outputted by said outputting means with a predetermined comparison value, and for turning on said switching means when said outputted value is smaller than the predetermined comparison value and turning off said switching means when said outputted value is larger than or equal to said predetermined comparison value, said current controlling device further comprising:

detecting means for detecting the voltage of said power source;

determining means for determining if a predetermined driving period has elapsed and thereupon deactivating said switching means; and controlling means for controlling said predetermined comparison value so as to be varied in an amount based upon the detected voltage, said predetermined comparison value being held constant throughout said predetermined solenoid driving period.

* * * * *